US005248149A

United States Patent [19]

Tarrats

[11] Patent Number: 5,248,149

[45] Date of Patent: Sep. 28, 1993

[54] METHOD OF PLAYING TIC-TAC-TOE WITH CARDS

[76] Inventor: Edward Tarrats, 28130 N. Seco Canyon Rd. #52, Saugus, Calif. 91350

[21] Appl. No.: 845,693

[22] Filed: Mar. 4, 1992

[51] Int. Cl.[5] ..... A63F 3/00

[52] U.S. Cl. ..... 273/271; 273/292

[58] Field of Search ..... 273/271, 292, 273

[56] References Cited

U.S. PATENT DOCUMENTS

| | | | |
|---|---|---|---|
| 3,649,023 | 3/1972 | Schohn | 273/271 X |
| 3,892,409 | 7/1975 | Herbert | 273/271 X |
| 4,813,681 | 3/1989 | Volpert, Jr. | 273/271 |
| 5,069,459 | 12/1991 | Zarnoti | 273/271 X |

*Primary Examiner*—V. Millin
*Assistant Examiner*—William M. Pierce
*Attorney, Agent, or Firm*—Christie, Parker & Hale

[57] ABSTRACT

A method of playing tic-tac-toe involves using cards and a playing grid of at least three-by-three with spaces to accommodate a card. The cards have at least two different types of indicia, for example, X's and O's. A first player draws a card from a deck of such cards and designates the type of card drawn as his type of card. The first player then places this card in an unused space in the grid. The second player then draws a card from the deck. If it is the same type as that designated for the first player, the second player discards it such as by placing it on top of the card which has already been played. If the card selected by the second player is of a different type from that designated for the first player, the second player places it in any unused space in the grid. In a preferred embodiment, the deck also includes cards which when played on top of any other card renders the space unused.

7 Claims, 4 Drawing Sheets

METHOD OF PLAYING TIC-TAC-TOE WITH CARDS

BACKGROUND OF THE INVENTION

The present invention relates to a method of playing tic-tac-toe, and more particularly to a method of playing tic-tac-toe using cards.

Everyone is familiar with tic-tac-toe. Its main advantages are that it is easy to learn, fun, and can be played virtually anywhere. However, it also has a disadvantage in that it has limited variations. In fact, if both players are familiar with the game, it is common to continually reach a draw.

SUMMARY OF THE INVENTION

The present invention combines the simplicity of tic-tac-toe with the element of chance to achieve a more interesting game which does not always result in a draw. According to the method of the invention, playing pieces representing at least two different types of elements, such as X's and O's are drawn in sequence from a source of such playing pieces, and placed on a game board. The playing pieces are preferably stackable.

In one embodiment, the playing pieces comprise playing cards having either an X or an O thereon. The first player selects a card from a deck of such cards. If the card has an O, the player is designated O, and if the card has an X, the player is designated X. A player places the O or X in a space on the playing board, which comprises a grid of three or more card accommodating spaces in length and width. Then, the second player, who is designated O, if the first player is designated X, or designated X if the first player is designated O, takes a card from the deck. If this card is the same as the first player's designated card type, it is of no use to the second player. Accordingly, the second player discards it by tossing it away, or stacking it on the first player's card. If the second player's selected card is different from the first player's designated card type, the second player places it on any open space on the playing board. Play continues in this way until one of the players has obtained a predetermined number, such as three, of his own card type in a row.

In a particularly preferred embodiment, the deck further includes blank cards, which, if drawn, can be placed over any card type to render the playing space empty again.

DETAILED DESCRIPTION OF THE PREFERRED EMBODIMENT

The present invention is a method of playing a game in which the object is to get three or more of playing pieces of the same type in a row. Preferably, the playing pieces are cards, with representations of different kinds of elements such as X's and O's. However, the playing pieces can be tiles or other items. It is also preferable that the playing pieces be stackable.

Figure 1:
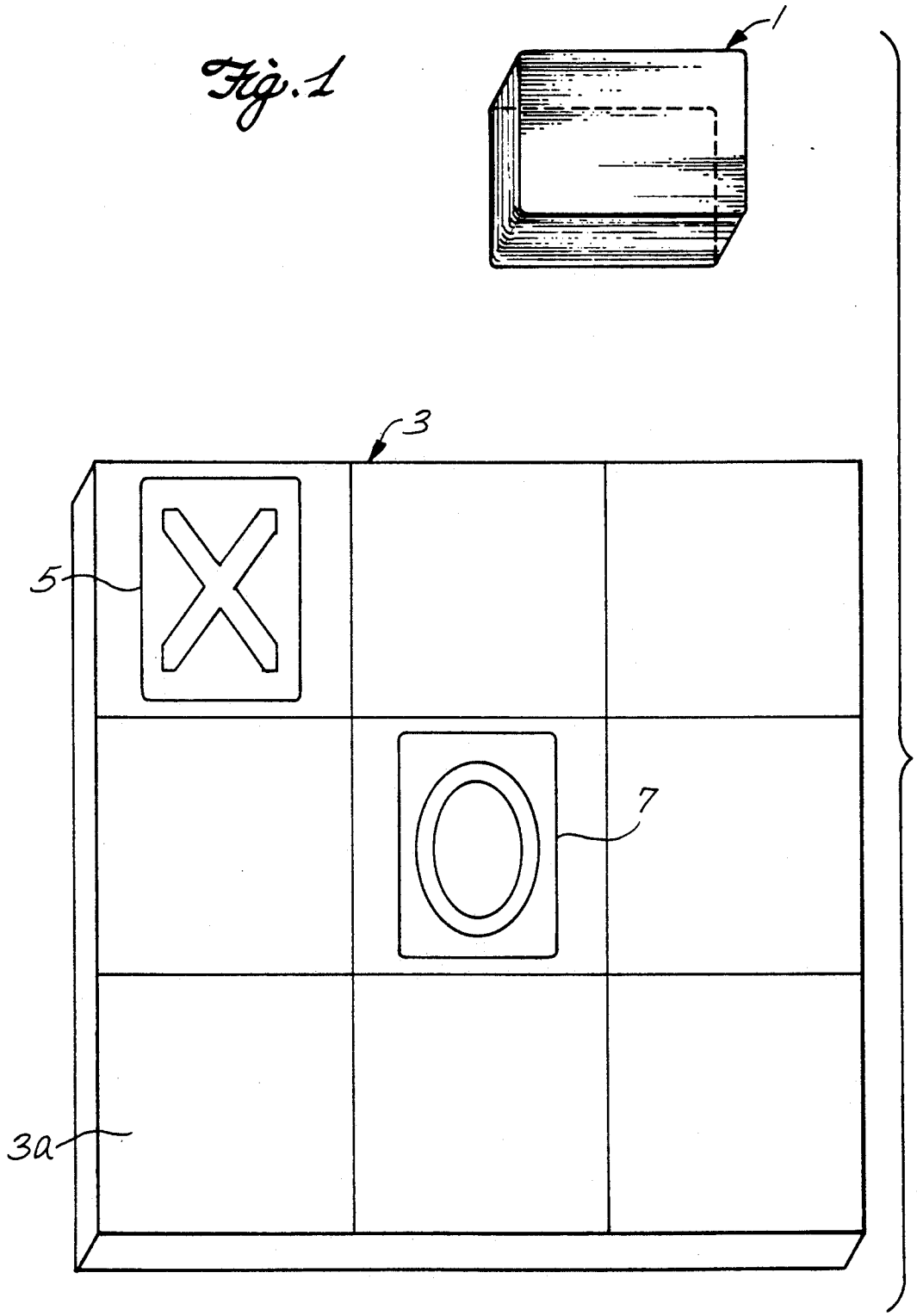
FIG. 1 is a perspective view showing a deck of cards, a playing board, and two cards positioned on the board.

A preferred embodiment is shown in the drawings. FIG. 1 shows a card deck 1, a playing board 3 forming a grid, and two cards 5,7 having an "X" and an "O", respectively. The deck has at least two types of cards, one type with X's and one type with O's, or other items. The board 3 is preferably a grid with sides of length sufficient to accommodate at least three cards, so that it has at least nine playing spaces 3*a*. The game proceeds with first and second players, alternately drawing cards from the deck, as follows:

The first player selects the top card from deck 1. If the card is an X, the first player is designated X and the second player is designated O. If the card is an O, the first player is designated O and the second player is designated X. The first player takes the card, e.g., an X, and places it in a playing space 3*a* such as where card 5 is.

The second player selects the next card from deck 1. If it is an O, he places it in an open space, e.g., where card 7 is. If it is an X, he cannot do anything with it because it is the first player's type of card. Therefore, he simply discards it by tossing it in a discard pile or by placing it on top of card 5. In effect, the second player loses his turn if he draws the first player's designated card type. If he draws his own designated card type, then he may place it in an open space, such as where card 7 was placed.

The first player selects the next card from deck 1. If it is an O, i.e., if it is the second player's type of card, he loses his turn. If it is his own type of card, i.e., an X, he can place it on any open plying space on board 3 in pursuit of three X's in a row (e.g., horizontally, vertically, or diagonally).

The second player selects the next card, and the game continues as explained above until one player has three of his designated card type in a row.

There are several possible variations of this game. One variation is to require more than three in a row, e.g., four in a row. The grid must be four-by-four or greater, as required. Another variation is to use more than two players, e.g., three. In this case, a third type of card would need to be used, e.g., a card having a square. Furthermore, all of the players will not know what their designated card type is until at least two players have drawn different card types. Moreover, each player will lose a turn if he draws a card type other than his own.

A further variation is to include blank cards in the deck. A player who draws a blank card may place it on top of any opposing player's card (or remove the opposing player's card) to thereby render the playing space neutral or open, even though it previously was controlled by an opposing player's card. Thus, a player drawing a blank can re-open a playing space. If the first player draws a blank on his initial turn, he can either be allowed to reselect a card from the deck or he loses his turn.

Figure 2:
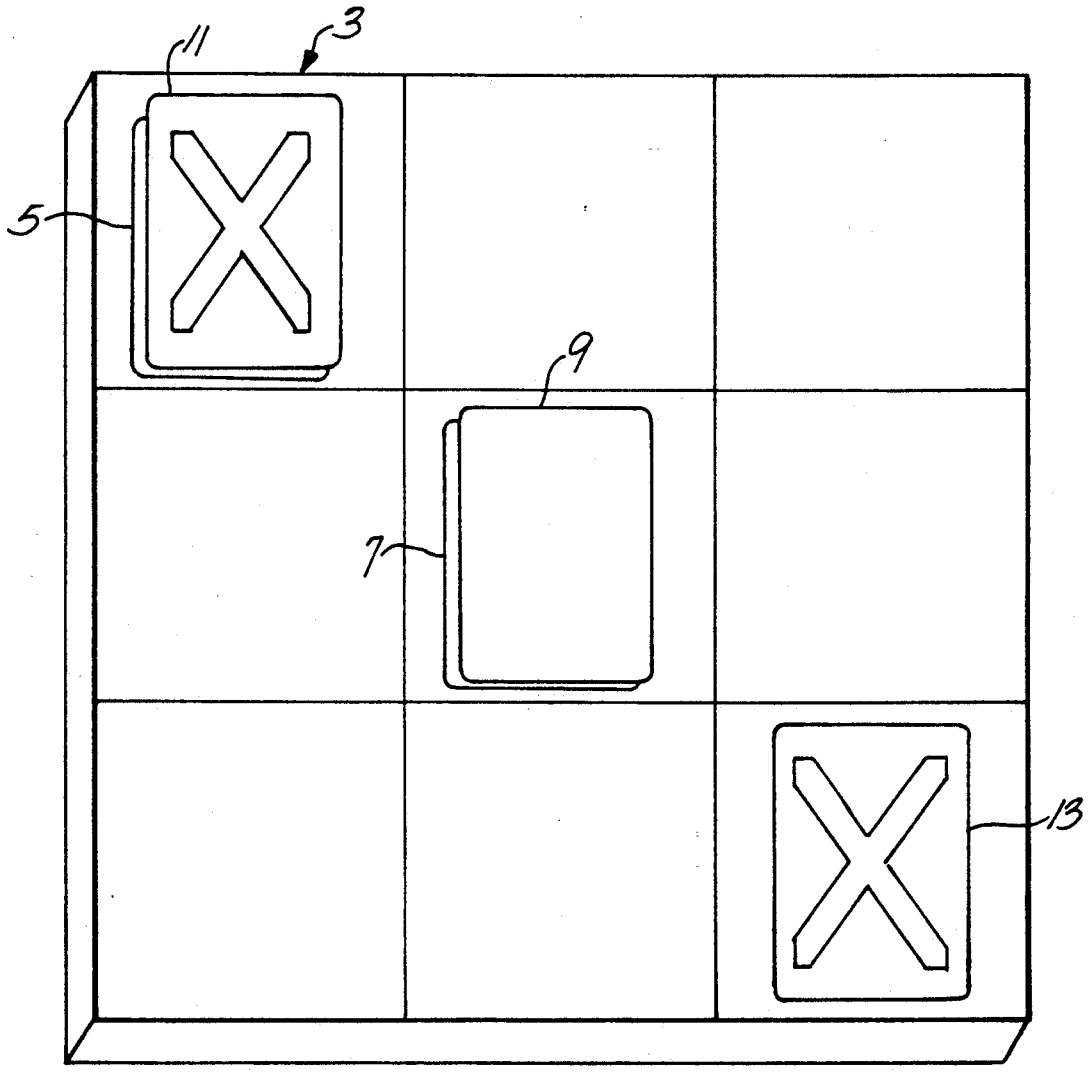
FIG. 2 is a view similar to FIG. 1 showing only the playing board with additional cards thereon.
Figure 3:
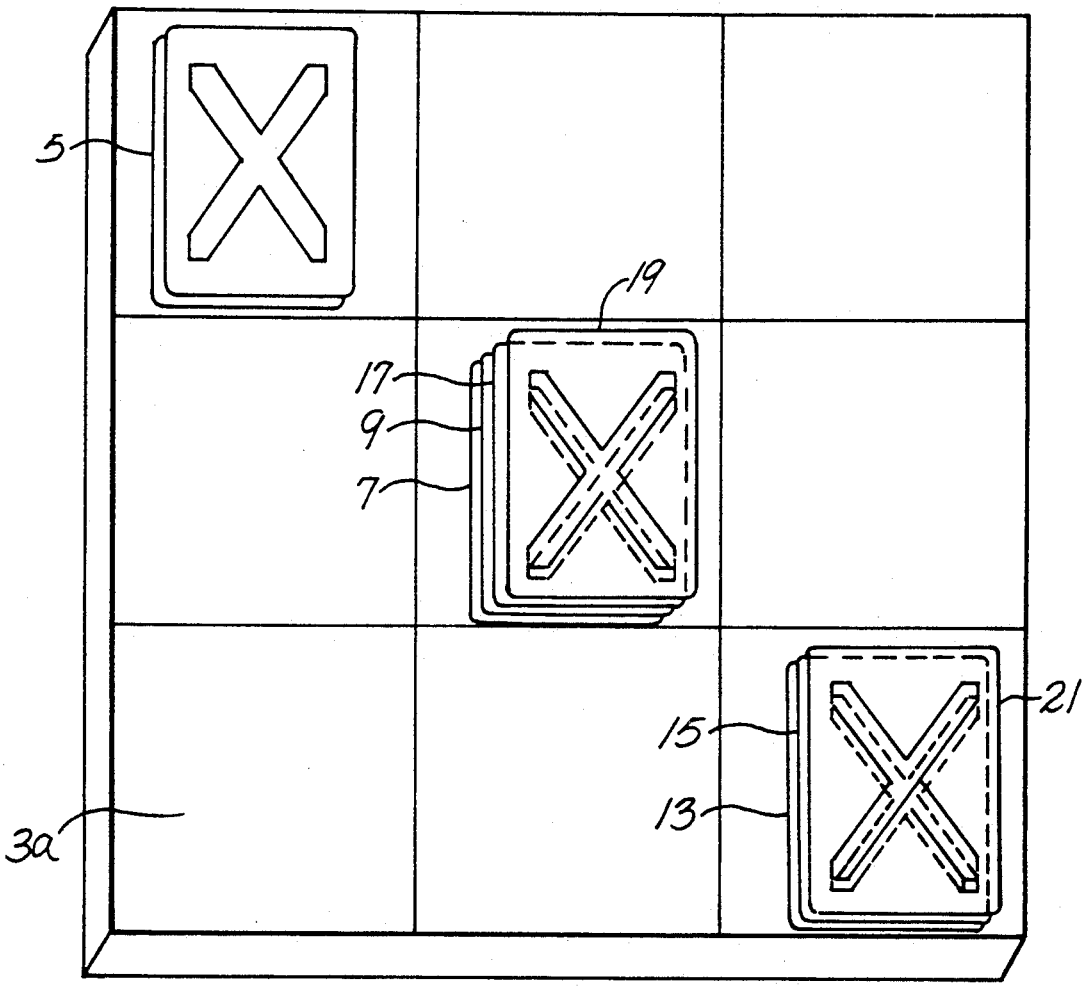
FIG. 3 is a view similar to FIG. 2 showing the board with still further cards thereon.

FIGS. 1, 2, and 3 taken together illustrate a variation of the game using blank cards, as well as X's and O's, and show how a hypothetical game started in FIG. 1 continues. As noted above, in FIG. 1, the first player drew an X, card 5, then the second player drew an O, card 7. In FIG. 2, the first player drew a blank, card 9, and placed it on the O, card 7. Then, the second player drew an X, card 11, and placed it on card 5. Then, the first player drew another X, card 13 and placed it in the opposite corner of the playing grid from card 11. The second player drew a blank 15 and placed it on the first player's card 13. Then, the first player drew another X, card 17, and placed it on the blank card in the center, card 15. The second player then drew another X, card 19, and placed it on card 17. Finally, the first player drew still another X, card 21, and placed it on the blank, card 15, in the corner of the grid to win the game by achieving three X's in a row.

In the above-described hypothetical game, the first and second players drew a disproportionate amount of X cards. In a real game, more O cards might be drawn which would undoubtedly prolong the game and make it more exciting. Moreover, it can readily be seen that the above-described variations of the game can be combined in part or in full.

Figure 4:
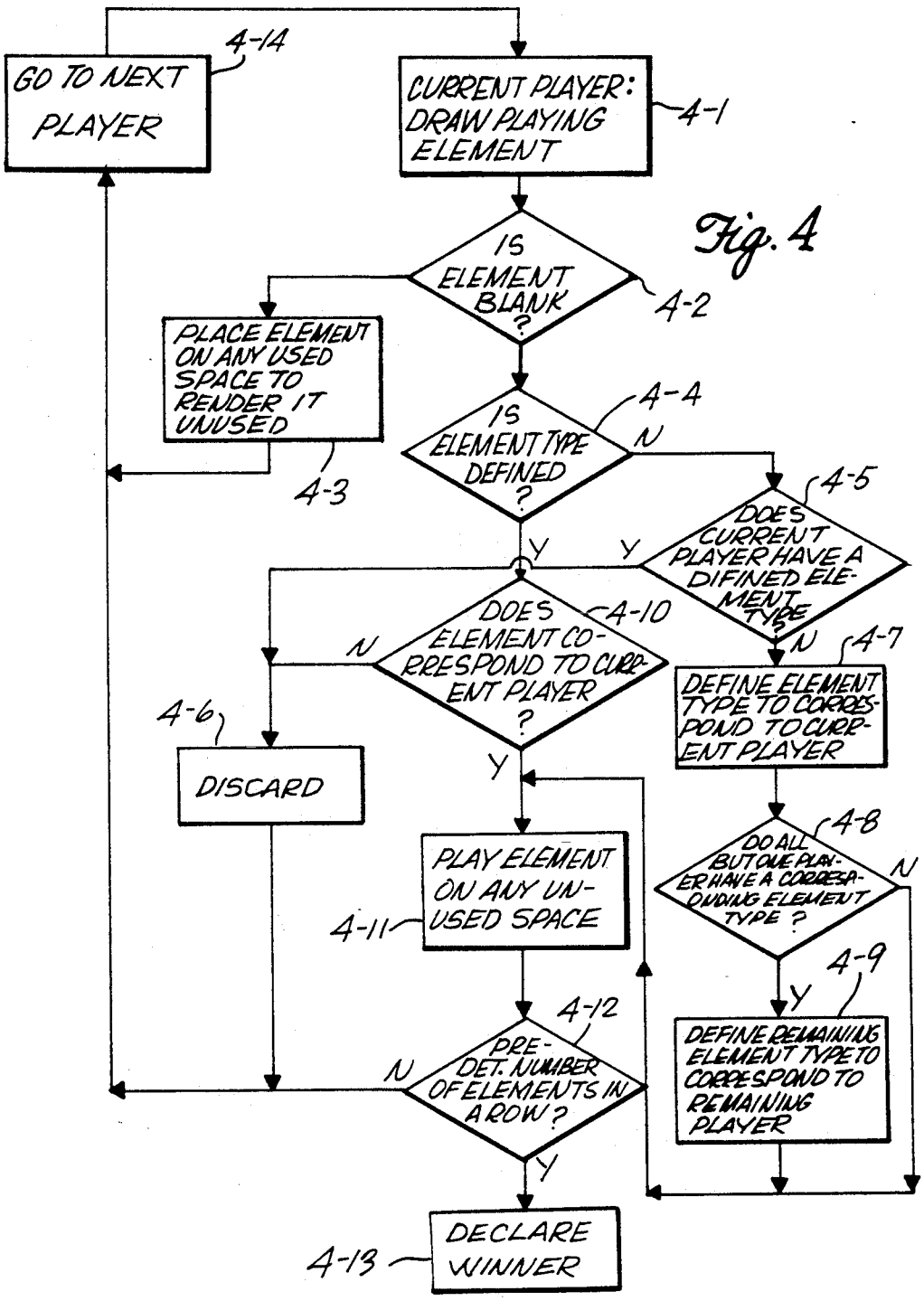
FIG. 4 is a flow chart of the method of playing the game according to the invention.

In the flow chart of FIG. 4, the main steps in the game can readily be seen. The game starts at step 4-1, where the current (first) player draws a playing element. If the element is blank (step 4-2), then the player places it on any used space (step 4-3). (If no spaces are used, the player can discard it.) If the element is not blank, and if it is an undefined element (step 4-4), the chart proceeds to step 4-5 to determine if the current player has a playing element type defined. If so, the playing element must be discarded (step 4-6) by the current player because two different element types cannot belong to the same player. If the player does not have a defined element type, in step 4-7, the element is defined as corresponding to the player. If all but one element type have been defined, the remaining element type can be defined as the remaining player having no corresponding playing element yet (steps 4-8 and 4-9).

If, at step 4-4, the selected playing element is defined, then it is determined whether the element type corresponds to the current player (step 4-10). If there is no match, the element is discarded at step 4-6. If there is a match, the player places the element on any unused spaced on the grid (step 4-1). If there are a predetermined number, e.g., three, of these type elements in a row (step 4-2), the game ends by declaring a winner (step 4-13). If not, or if a card has been discarded or played, then it is the next player's turn (steps 4-14 and 4-1).

It is noted that at step 4-8, if fewer than all but one playing elements are defined, or if step 4-9 has been performed, the player proceeds to step 4-11 and plays the element on any unused space. This is because, back at step 4-7, the element has been defined as corresponding to the current player's element type.

The above description of the preferred embodiment is not intended to be exclusive, rather, many other variations of the invention will be evident to one of ordinary skill in the art, such as use of an "imaginary" playing board, i.e., where the players place the cards or playing pieces in rows using their own judgment, rather than an actual grid. The claims are thus intended to cover the invention, including such evident variations.

What is claimed is:

1. A method of playing a game for a plurality of players using a source of playing elements and taking successive turns of play, each element having indicia of a first type and second type, and a grid of playing spaces, each of the playing spaces for accommodating a playing element, the method comprising the steps of:

(a) drawing a playing element by a first player from the source of playing elements;

(b) placing the playing element in any unused space on the grid if the playing element is of the first type and discarding the playing element if it is of a type other than the first type whereby said first player loses his turn of play;

(c) drawing a next playing element by a second player from the source of playing elements;

(d) placing the next playing element in any unused space in the grid if the next playing element is of the second type, and discarding the next playing element if the next playing element is of a type other than the second type whereby said second player loses his turn of play; and (e) repeating steps (a) to (d) until there are a predetermined number of spaces in a row occupied by playing elements of the same type, wherein steps (a) to (d) are performed by a selected one of the plurality of players, and each successive time steps (a) to (d) are performed, the selected player changes.

2. The method of claim 1, wherein the step of repeating steps (a) to (d) until there are a predetermined number of spaces in a row occupied by playing elements of the same type comprises repeating steps (a) to (d) and ending the game when there are three spaces in a row occupied by playing elements of the same type and declaring a winner.

3. The method of claim 1, wherein the playing elements are cards, and the steps of discarding in step (b) and in step (d) comprise playing a card on top of another card which is of the same type and which has already been placed in a space in the playing grid.

4. A method of playing a game for a plurality of players using a source of elements and taking successive turns of play, each element having indicia of a first type, second type, and third type, and a grid of playing spaces, each for accommodating a playing element, the method comprising the steps of:

(a) drawing a playing element by a first player from the source of playing elements;

(b) playing the playing element in any unused space if the playing element is of the first type, discarding the playing element if the playing element is of the second type whereby said first player loses his turn of play, and placing the playing element on top of any other playing element to render a space unused if the playing element is of the third type;

(c) drawing a next playing element by a second player from the source of playing elements;

(d) placing the playing element in any unused space if the playing element is of the second type, discarding the playing element if the playing element is of the first type whereby said second player loses his turn of play, and placing the playing element on top of any other playing element to render a space unused; and (e) repeating steps (a) to (d) until there are a predetermined number of spaces in a row occupied by playing elements of the same type, wherein steps (a) to (d) are performed by a selected one of the plurality of players, and each successive time steps (a) to (d) are performed, the selected player alternates.

5. The method of claim 4, wherein the step of repeating steps (a) to (d) until there are a predetermined number of spaces in a row occupied by playing elements of the same type comprises repeating steps (a) to (d) and ending the game when there are three spaces in a row occupied by playing elements of the same type and declaring a winner.

6. The method of claim 4, wherein the playing elements are cards, and the steps of discarding in step (b) and in step (d) comprise playing a card on top of another card which is of the same type and has already been placed in a space in the playing grid.

7. The method of claim 4, wherein steps (a) and (b) are performed by a first player, and steps (c) and (d) are performed by a second player, and the method further comprises a step of designating the first type of playing element as corresponding to the first player and the second type of playing element as corresponding to the second player.

* * * * *